United States Patent [19]

Waggoner

[11] Patent Number: 4,995,308

[45] Date of Patent: Feb. 26, 1991

[54] ROOF VENTILATING APPARATUS

[75] Inventor: Richard L. Waggoner, Riverside, Calif.

[73] Assignee: Alumax Inc., San Mateo, Calif.

[21] Appl. No.: 356,432

[22] Filed: May 24, 1989

[51] Int. Cl.[5] ..... F24F 7/02

[52] U.S. Cl. ..... 98/37; 98/DIG. 6; 52/95

[58] Field of Search ..... 98/29, 32, 37, 42.21, 98/121.1, DIG. 6; 52/57, 95, 199

[56] References Cited

U.S. PATENT DOCUMENTS

| | | | |
|---|---|---|---|
| 678,189 | 7/1901 | Marshall | 52/95 |
| 1,230,305 | 6/1917 | Klay | 98/42.21 X |
| 1,717,728 | 6/1929 | Moore | 98/42.21 |
| 2,350,771 | 6/1944 | Klunder | 98/37 |
| 2,777,381 | 1/1957 | Noyes et al. | 98/37 |
| 2,803,185 | 8/1957 | Coleman | 98/DIG. 6 X |
| 2,868,104 | 1/1959 | Honholt et al. | 98/42.21 |
| 2,936,723 | 5/1960 | Waldron | 52/302 |
| 2,954,727 | 10/1960 | Katt | 98/32 X |
| 3,196,773 | 7/1965 | Lorenz | 98/32 |
| 3,236,170 | 2/1966 | Meyer et al. | 98/42.21 |
| 3,241,474 | 3/1966 | Rousey | 98/42.21 |
| 3,949,657 | 4/1976 | Sells | 98/42.21 |
| 4,201,121 | 5/1980 | Brandenburg | 98/42.21 X |
| 4,254,598 | 3/1981 | Rugroden | 52/199 |
| 4,278,071 | 7/1981 | Brill-Edwards | 126/428 |
| 4,280,399 | 7/1981 | Cunning | 98/42.21 |
| 4,446,661 | 5/1984 | Jonsson et al. | 52/95 |
| 4,611,443 | 9/1986 | Jorgensen | 52/95 |
| 4,642,958 | 2/1987 | Pewitt | 52/302 |
| 4,762,053 | 8/1988 | Wolfert | 98/37 |
| 4,776,262 | 10/1988 | Curran | 98/37 |

FOREIGN PATENT DOCUMENTS

| | | | |
|---|---|---|---|
| 1073258 | 3/1980 | Canada | 98/32 |
| 549031 | 11/1942 | United Kingdom | 98/37 |
| 2193515 | 2/1988 | United Kingdom | 98/32 |

OTHER PUBLICATIONS

"Principles of Attic Ventilation", Fourth Edition, Air Vent Inc., Peoria Heights, Ill., 1985.

*Primary Examiner*—Harold Joyce
*Attorney, Agent, or Firm*—Raymond B. Cranfill

[57] ABSTRACT

A fascia ventilator which is low in profile and comprises a vent member and a cover member. The vent member is provided with either apertures or channels through which air may pass. The ventilator is further provided with a fiberglass mesh filter for excluding entry of insects and similar pests.

4 Claims, 5 Drawing Sheets

ROOF VENTILATING APPARATUS

FIELD OF THE INVENTION

The present invention relates generally to ventilation of building spaces under roofs and like structures and more particularly to fascia ventilators used to ventilate roofs through gaps in roof cornices.

BACKGROUND OF THE INVENTION

The need for venting hot and humid air from building spaces beneath roofs is well known. Without adequate and controlled ventilation of attics and like spaces, damage results to the roof structure, as well as to articles stored within the attic or like space. For instance, accumulated attic heat during cold winters may melt snow on the roof which can then refreeze in and damage gutters and drainage systems. Furthermore, lack of proper ventilation makes cooling and heating the remainder of the building more difficult, and permits the accumulation of condensed moisture which reduces effectiveness of insulation and may result in stained interior panels as well as promote mildew.

Generally speaking, ventilation through a roof cornice or similar structure is accomplished using soffit ventilators. Such ventilators are positioned under the roof overhang, allowing air to pass into the roof through horizontally arrayed vents. See, for example, U.S. Pat. Nos. 4,776,262; 4,611,443; and 4,201,121. Soffit ventilators are inferior because their positioning requires that the roof have a high profiles which necessitate additional building materials and expense and destroy the aesthetic character of the roof. See for example, U.S. Pat. Nos. 4,776,262; 4,611,443; and 3,241,474. Furthermore, these ventilators are in many cases are bulky, cumbersome and very expensive to manufacture. Another common problem is an inadequate ability to exclude insects and other pests.

Thus, there is a need for cornice ventilating apparatus that is simple in construction, durable and easy to adapt to the existing conformities of a roof, that is low in profile relative to the roof structure, and that is capable of preventing insects and other pests from entering the building space.

SUMMARY OF THE INVENTION

An object of the present invention is to provide ventilating apparatus that simple, lightweight and inexpensive to manufacture and install and yet is sufficiently strong and durable so as not to require further reinforcement or modification once installed.

Another object of the present invention is to provide ventilation apparatus that is low in profile relative to roof configuration.

A further object of the present invention is to provide ventilation apparatus that is easily adaptable to non-planar roof surfaces.

Another object of the present invention is to provide ventilating apparatus capable of excluding entry of precipitation and insects or other pests into the space to be ventilated.

The present invention achieves these objectives by providing novel fascia ventilators positioned over the cornices of a roof.

The fascia ventilator comprises an assembly configured to be received over and attached to a gap in a cornice of the roof. The assembly includes an aperture or channeled member through which air from the outside may enter the building space and a cover member to prevent introduction of precipitation and, in the case of the aperture member, to prevent outside air from blowing directly into the apertures. Positioning the ventilation apparatus on the fascia as opposed to under the soffit is advantageous because it allows the roof cornice to have a lower profile. Fascia ventilators are also advantageous in that they permit ventilation to occur along the entire length of the cornice. The fascia ventilators described herein are further advantageous in that they are simple and inexpensive to construct and are easily adaptable.

The ventilators of the present invention are also provided with a fiberglass filter to prevent entry of insects or other like pests from entering the building space. Furthermore, these fascia ventilators can be provided with plastic adapter members, either incorporated into the ventilators or as separate pieces, that permit these ventilators to be adapted to roofing that has a non-planar surface. This is advantageous because it allows for an airtight and watertight seal to be formed between the roof and ventilator and because it obviates the need to produce specific ventilators which are specially configured for a particular roof surface.

DESCRIPTION OF THE PREFERRED EMBODIMENTS

Figure 1:
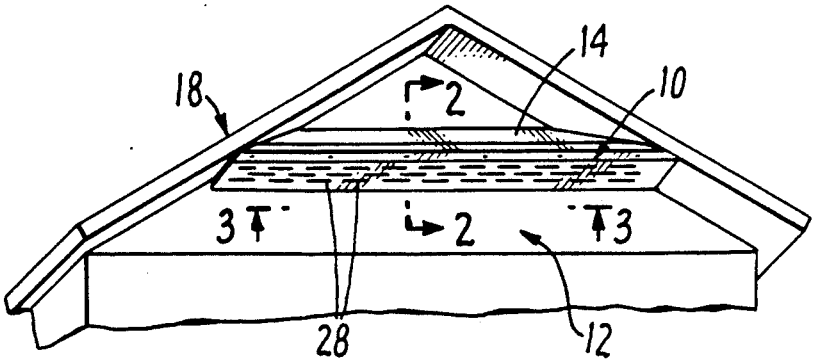
FIG. 1 is a view in perspective of a first embodiment of the gable ventilator of the invention.
Figure 2:
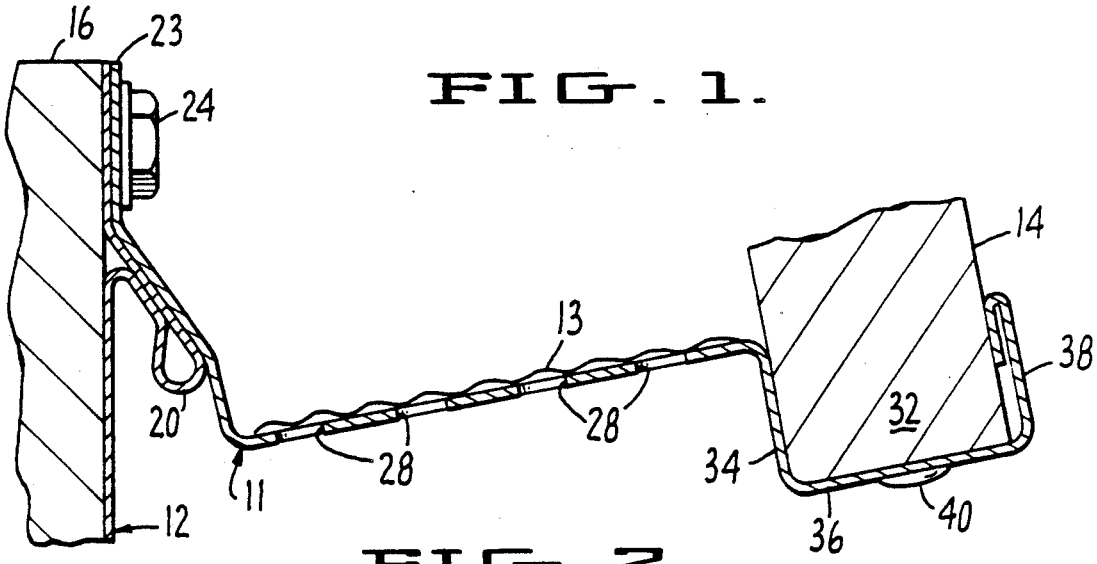
FIG. 2 is a view in cross-section of the first embodiment of the gable ventilator taken on the plane designated by line 2—2 in FIG. 1.
Figure 3:
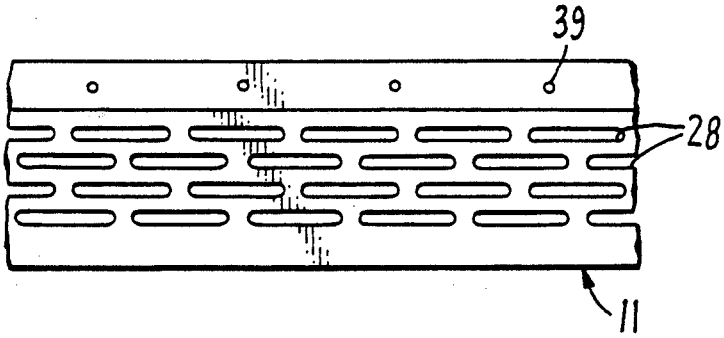
FIG. 3 is a bottom plan view of the ventilating member of the first embodiment of the gable ventilator taken on the plane designated by the line 3—3 in FIG. 1.
Figure 4:
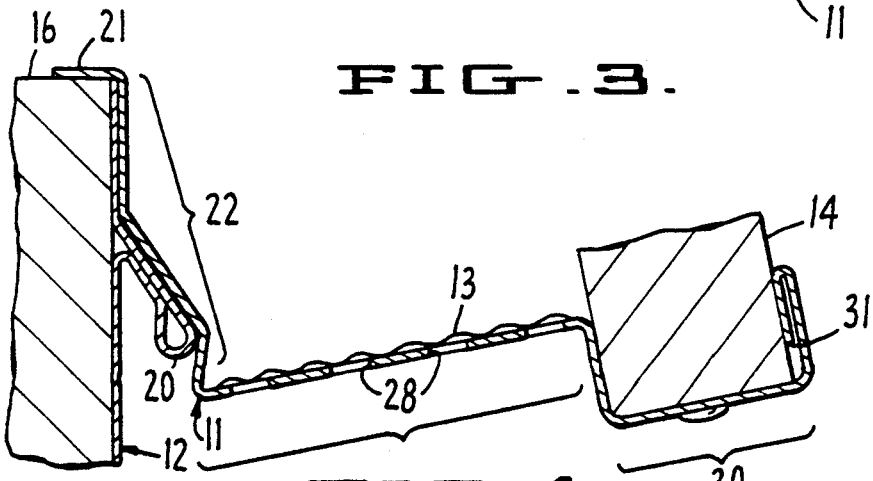
FIG. 4 is a view in cross-section of a second embodiment of the gable ventilator of the invention.
Figure 5:
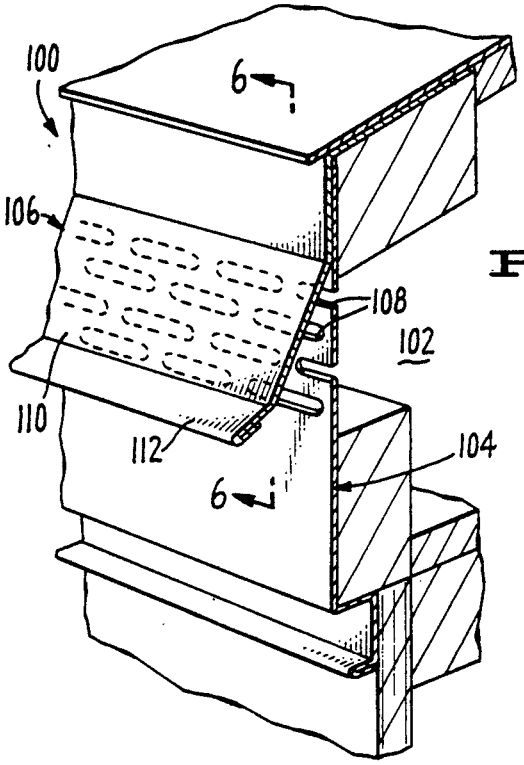
FIG. 5 is a cross-sectional view in perspective of a first embodiment of the fascia ventilator of the invention.
Figure 6:
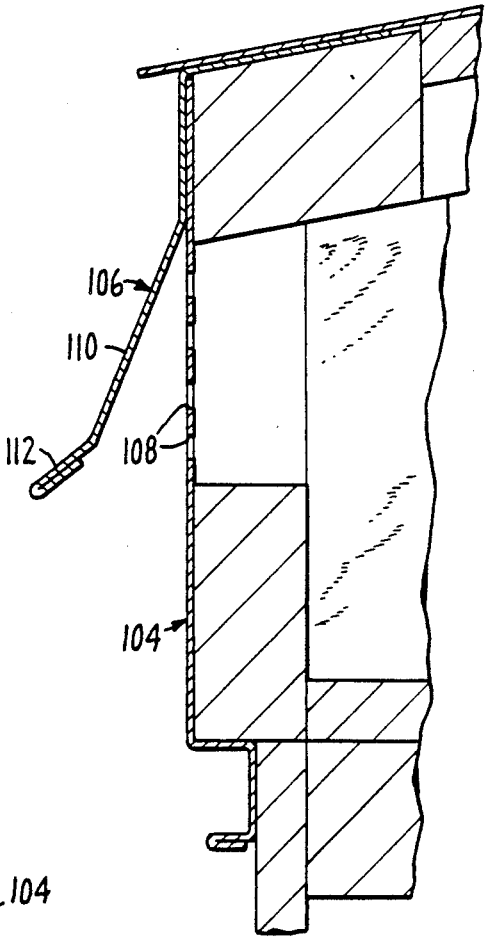
FIG. 6 is a view in cross-section of the first embodiment of the fascia ventilator taken along the line 6—6 in FIG. 5.
Figure 7:
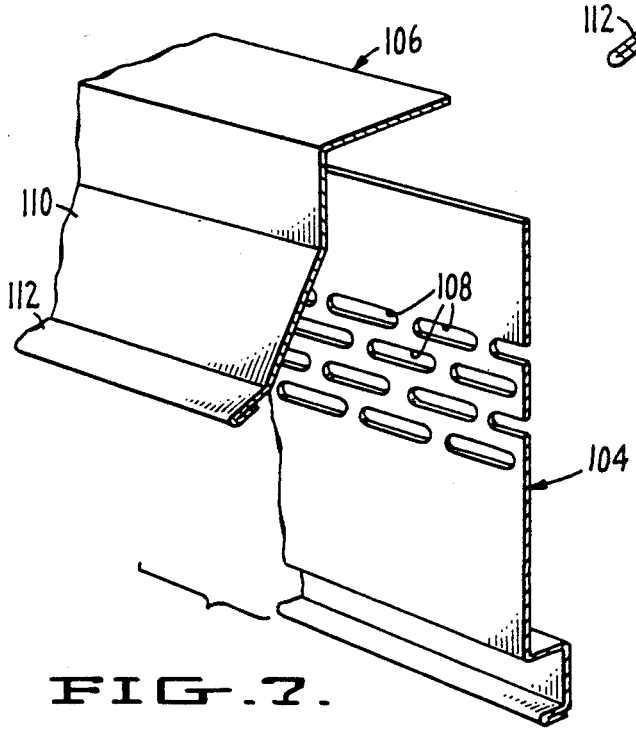
FIG. 7 is an exploded view in perspective of the cover member and ventilating member of the first embodiment of the fascia ventilator.

Referring now to FIGS. 1–4, the gable ventilator 10 of the present invention will be described. The gable ventilator 10 is comprised of a vent member 11, a bracket 12 and a filter 13, the assembly of which receives and displaces an eave panel 14 so that air may enter the building through the gable.

The bracket 12 is used to support and position the vent member 11 and eave panel 14 at any convenient position along a wall 16 of a gable 18. The bracket 12 is provided with a lip 20 which runs transversely the length of the bracket. In the preferred embodiment, the lip 20 is formed by folding the bracket 12 back on itself which gives the lip 20 a hairpin configuration in cross-section. The lip 20 assists in supporting the gable vent 11. The bracket 12 is configured to receive screws 24 which secure it in place. Alternatively, the bracket may be provided with an anchor 21 which is received over an end of the gable wall 16, thereby positioning the gable ventilator 10 and holding it in place once the eave panel 14 is secured to the gable vent 11 and the gable 18. The bracket 12 may be fabricated from any suitably durable material such as metal or polymer plastic.

The gable vent 11 comprises an elongate sheet that is divided into three main portions. The first portion 22 runs the length of the gable vent 11 along the first free edge 23, and is configured to be received over the bracket 12. In the embodiment shown in FIG. 2, the first portion 22 of the gable vent 11 is provided with holes (not shown) for receiving screws 24. The second portion 26 of the gable vent 11 is contiguous with and extends parallel to the first portion 22. This second portion 26 is substantially planar and is provided with a plurality of apertures 28 allowing air to pass through the gable 18 into the building structure. The third portion 30 of the gable vent 11 is contiguous with and runs parallel to the second portion and includes the second free edge 31, and is configured to receive and secure the eave panel 14. In the preferred embodiment, the third portion provides a groove 32 having a first wall 34, a second wall 36, and a third wall 38. The second free edge 31 is reflexed back on itself into the groove 32. The eave panel 14 is emplaced in groove 32 where it is held in place by frictional force created by the reflexed second free edge 31 pushing the eave panel 14 into contact with the first wall 34 of the groove 32. In addition, the second wall 36 of groove 32 may be provided with holes 39 to receive screws 40 which can be used to secure the eave panel 14 within the groove 32 of the gable vent 11. The gable vent 11 may be fabricated from any durable material, although polymer plastic is preferable on account of its light weight and low cost.

The filter 13 is affixed to the internal surface of the gable vent 11 over the apertures 28 so that no air may pass through the apertures 28 into the building without first passing through the filter 13. The filter itself may be composed of a variety of materials although spun fiberglass, such as angel's hair, is preferred. The filter should be of adequate density and thickness so as to prevent the ingress of insect and like pests, such as wasps, termites, etc. into the interior of the building.

The gable ventilator 10 may be installed along one eave panel 14 of a gable as shown in FIG. 1, or may be installed along several panels, depending upon the degree and rate of ventilation desired. Ventilation through the gable may be achieved in one of two ways. Two or more gable ventilators may be used on opposite sides of a roof construction to permit air to flow through the roof construction. In addition, the gable ventilator may be used in combination with a ridge cap ventilator, wherein the gable ventilator provides an opening for air to enter the interior building space as it is lost through the roof ridge by eduction.

FIGS. 8–15 illustrate various embodiments of the ridge cap ventilator 50 of the present invention. The ridge cap ventilator 50 is configured for receipt over a roof ridge or crest having a gap 52. The roof ridge may divide the roof into two sloping roof sides 54, or in some cases, the gap 52 may run along a roof ridge that divides a roof side 54 and a vertical wall (not shown). The ridge cap ventilator 50 of the present invention is adaptable to either of these roof configurations.

In one embodiment of the present invention, as shown in FIGS. 8–11, the ridge cap ventilator 50 comprises support members 56, ventilating members 58, a cover member 60 and a filter 62. The support members 56 are elongate sheets configured to the length of the roof ridge gap. The support members 56 are affixed by known methods to the roof sides 54 proximate to the roof ridge gap 52. The members 56 may be in direct contact with the roof side 54 or more preferably, they are attached to roofing material 64 which is already in place over the roof sides 54. Each support member 56 is provided with a flange 66 that runs parallel to but which is displaced away from the roof ridge gap 52. The support members 56 may be made of polymer plastic, metal or other material which has sufficient strength and is not easily weathered.

The filter 62 is received over the roof ridge gap 52 and is affixed to the support members 56 such that no air exchange through the roof ridge gap 52 can take place without passing through the filter 62. The filter 62 is used to exclude insects and other vermin and has the same characteristics as the filter 13 of the gable ventilator 11.

Figures 8, 9, 10, 11:
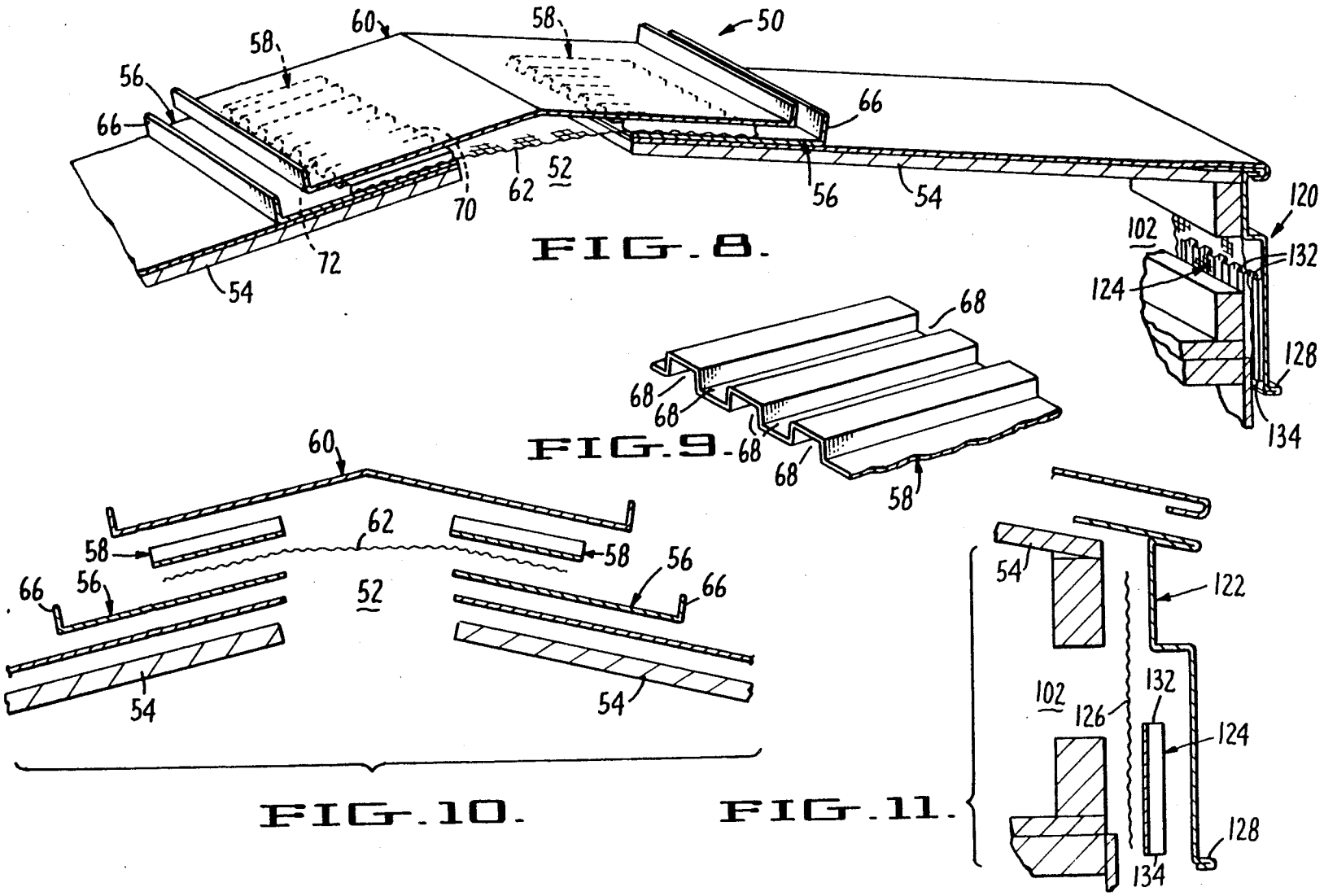
FIG. 8 is a cross-sectional view in perspective of a roof construction incorporating a first embodiment of a ridge cap ventilator and a second embodiment of a fascia ventilator of the invention.
FIG. 9 is a view in perspective of a portion of the ventilating member of the ridge cap ventilator shown in FIG. 8.
FIG. 10 is an exploded view in cross-section of the first embodiment of the ridge cap ventilator.
FIG. 11 is an exploded view in cross-section of the second embodiment of the fascia ventilator.
Figure 12:
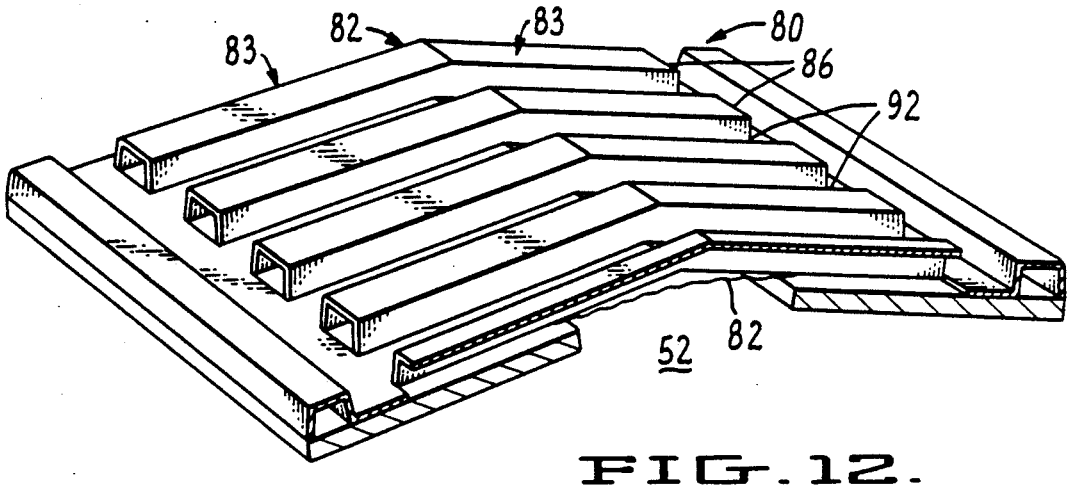
FIG. 12 is a cross-sectional view in perspective of a second embodiment of a ridge cap ventilator of the invention.
Figure 13:
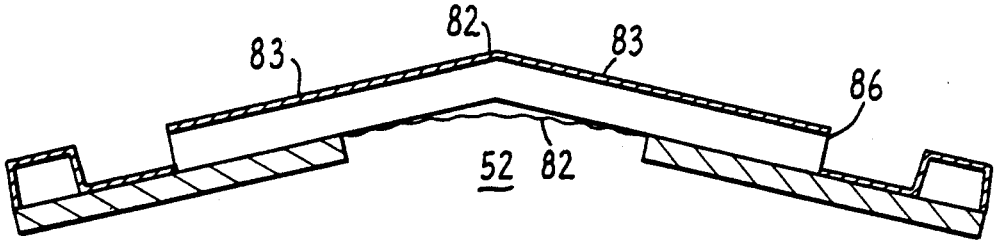
FIG. 13 is a view in cross-section of the second embodiment of the ridge cap ventilator.

The ventilating members 58 comprise sheets as shown in FIG. 9. These sheets are emplaced over the support members 56, with the filter 62 sandwiched between. The ventilating members 58 should be configured and emplaced such that they are substantially adjacent to the roof ridge gap 52 and are set back from the flange 66 of the support member 56. Although they can be fabricated from any rigid material, the ventilating members are preferably made of polymer plastic.

The cover member 60 is configured for receipt by the ventilating members 58, so that the roof ridge gap 52 is bridged. It should be noted that the mating of the ventilating members 58 with the cover member 60 above and with the support members 56 below creates a single row of channels 68 in the ventilating members 58. These channels have upwardly facing apertures 70 in communication with air present in the roof ridge gap 52 and downwardly facing apertures in communication with air outside the building. The closing of the roof ridge gap 52 with the cover member 60 constrains air to pass only through the channels 68.

While not wishing to be bound by any theory of operation, it appears that ventilation is achieved when rising warm air creates a slightly greater pressure at the roof ridge, eventually forcing the warm air up through the roof ridge gap 52 and then down through the channels 68 to the outside. The flange 66 seems to be crucial in this context in that it prevents air from blowing directly into the downwardly facing apertures 72 of the channels 68 and thereby disrupting the flow of air out of the building space. In addition, the flange 66 prevent the ingress of precipitation.

An alternative embodiment is shown in FIGS. 12–15. Ridge cap ventilator 80 comprises a ventilating member 82 and a filter 82. The ventilating member is form molded from a single piece of plastic, along a longitudinal axis to form two opposing, downwardly sloping sides 83, and is configured to be received over the roof ridge gap 52 and be joined with the roof sides 54. The ventilating member 82 is provided with a plurality of substantially parallel raised ribs 86 alternating with troughs 92 which extend downward along both sides 83. Each rib 86 is provided with a downwardly facing terminal aperture 88 that is in communication with the outside air at each of the two ends of the rib 86. The ventilating member 82 is further provided with a raised strip or flange 90 on each side 83. The flange 90 has a longitudinal axis that is perpendicular to the longitudinal axes of the ribs 86, and is spaced away from the ends of the ribs 86. The filter 84 is used to exclude insects and other vermin and has the same characteristics as the filter 13 of the gable ventilator 11.

The ridge cap ventilator 80 is installed as follows. First, the filter 84 is laid over the roof ridge gap 52 and affixed to roof sides 54 such that no air exchange through the roof ridge gap 52 can take place without passing through the filter 84. Next, the ventilating member 82 is positioned over the roof ridge gap 52 and affixed to roof sides 54 by known methods. The joinder of the ventilating member 82 with the roof sides 54 creates channels 90 in the portions of the raised ribs that project over the roof sides 54. Eduction of air from the interior building space to the outside occurs in a fashion similar to that described for ridge cap ventilator 50. However, in the present embodiment, the air conducting channels alternate with non-conducting troughs 92, whereas in the ridge cap ventilator 50, an unbroken row of air conducting channels 68 is present.

Figure 14:
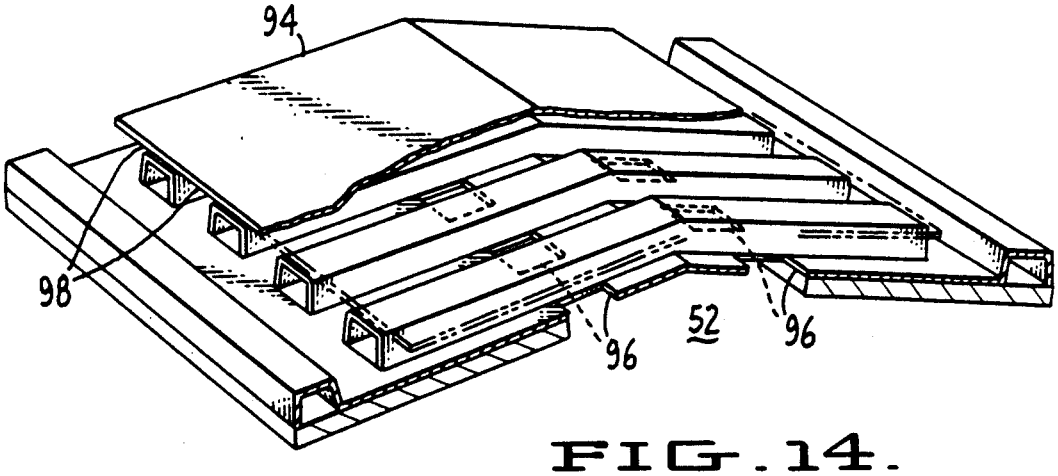
FIG. 14 is a cross-sectional view in perspective of a third embodiment of a ridge cap ventilator of the invention.
Figure 15:
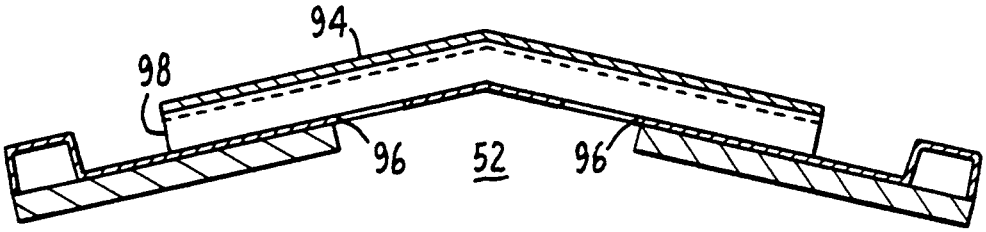
FIG. 15 is a view in cross-section of the third embodiment of the ridge cap ventilator.

A variation of the ridge cap ventilator 80 is illustrated in FIGS. 14 and 15. Here, a cover member 94 has been affixed over the ventilating member 82. In addition, a pair of medial apertures 96 have been added to each trough 92. The addition of the cover member 94 creates a second set of channels 98 by closing the troughs 92. The medial apertures 96 permit communication of the troughs with air present in the roof ridge gap 52, while the troughs 92 remain in communication with outside air. This configuration has the effect of increasing the educing capacity of the ventilating member by providing a contiguous series of air educing channels.

The fascia ventilator 100 according to one embodiment of the present invention is shown in FIGS. 5–8. In this aspect of the invention, a roof edge or cornice is provided with a cornice gap 102, which the fascia ventilator 100 is configured to cover. In this embodiment, the fascia ventilator 100 comprises a ventilating member 104 and a cover member 106. The ventilating member 104 is provided with a plurality of elongate apertures 108 to permit the passage of air into the interior of the building through the cornice gap 102. The ventilating member 104 is configured for snug receipt over the cornice so that the apertures 108 are aligned over the cornice gap 102. The ventilating member can be fabricated from any durable, resilient material, although polymer plastic and metal are preferred.

The cover member 106 comprises a sheet that is configured to be received over and attached to the upper edge of the roof cornice and is further configured to project downward for a distance sufficient to extend over the apertures 108 of the ventilating member 104. The lower portion of the cover member 106 does not close off the apertures 108, but rather is bent longitudinally to form a panel 110. The panel 110 projects out of the plane occupied by the aperture portion of the ventilating member 104 such that outside air and precipitation cannot enter the cornice gap 102 directly. The panel 110 is further configured to provide a drip lip 112 which prevents precipitation shed by the cover member 106 from running down the sides of the building. The cover member 106 may be fabricated from any durable, moldable material that is not easily weathered, although metal is preferred.

A fascia ventilator 120 in accordance with an alternative embodiment of the present invention is illustrated in FIGS. 8 and 11. In this embodiment, the fascia ventilator 120 comprises a cover member 122, a ventilating member 124, and a filter 126.

The ventilating member 124 comprises a piece of corrugated material similar in all respects to the ventilating member 58 of the ridge cap ventilator 50, as shown in FIG. 9. It is configured to be received on the surface of the cornice beneath the cornice gap 52. It can be comprised of any durable, moldable material, although polymer plastic is preferable.

The cover member 122 is configured to be received at the top of the cornice and to extend over the cornice gap 52 and be joined with the ventilating member 124. It is provided with a drip lip 128 which allows precipitation to be shed from the cornice without coming in contact with and running down the building wall. The cover member 122 may be fabricated from any durable, moldable material that is not easily weathered, although metal is preferred. The filter 126 in similar in purpose and structure as the filter 13 already described and is affixed over the cornice gap to ensure that insects and like pests are excluded from the interior building space.

The sandwiching of ventilating member 124 between the surface of the cornice and the cover member 122 creates a series of channels 130 with upward facing apertures 132 in communication with air in the cornice gap 52 and downward facing apertures 134 in communication with outside air. Air entering the building interior through the cornice gap is thus constrained to pass through the channels 130.

In operation, the fascia ventilator is used in combination with a ridge cap ventilator. As air is educed through the roof ridge, it is replaced by air flowing in from the outside through the fascia ventilators.

Figure 16:
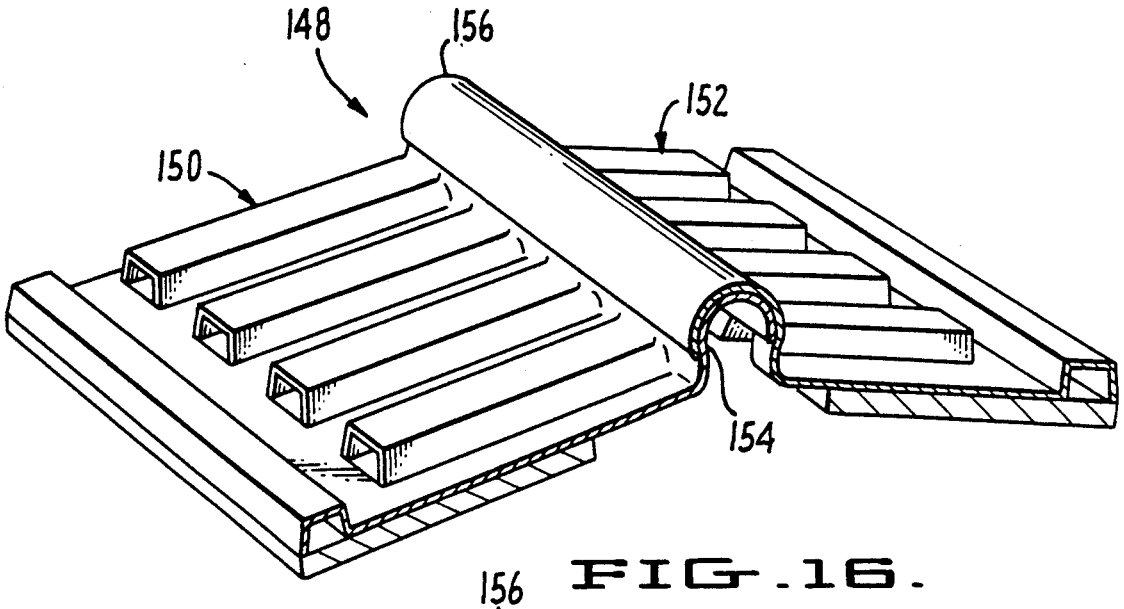
FIG. 16 is an exploded cross-sectional view in perspective of a first embodiment of a roof adaptor in combination with the third embodiment of the ridge cap ventilator.
Figure 17:
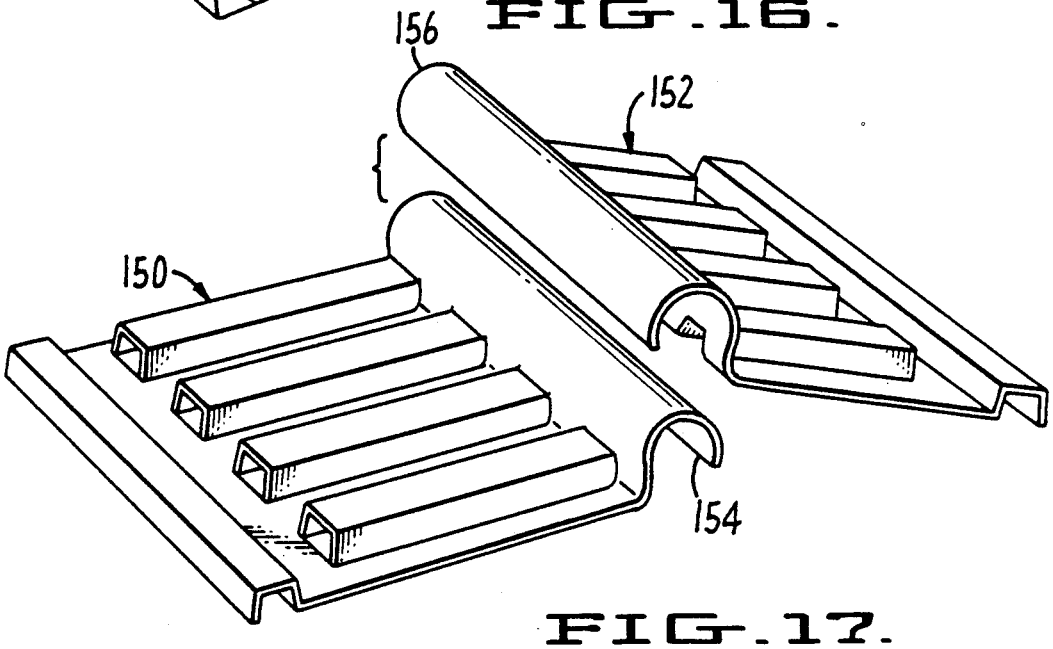
FIG. 17 is a partial view in cross-section of the first embodiment of a roof adaptor in combination with the third embodiment of the ridge cap ventilator.
Figure 18:
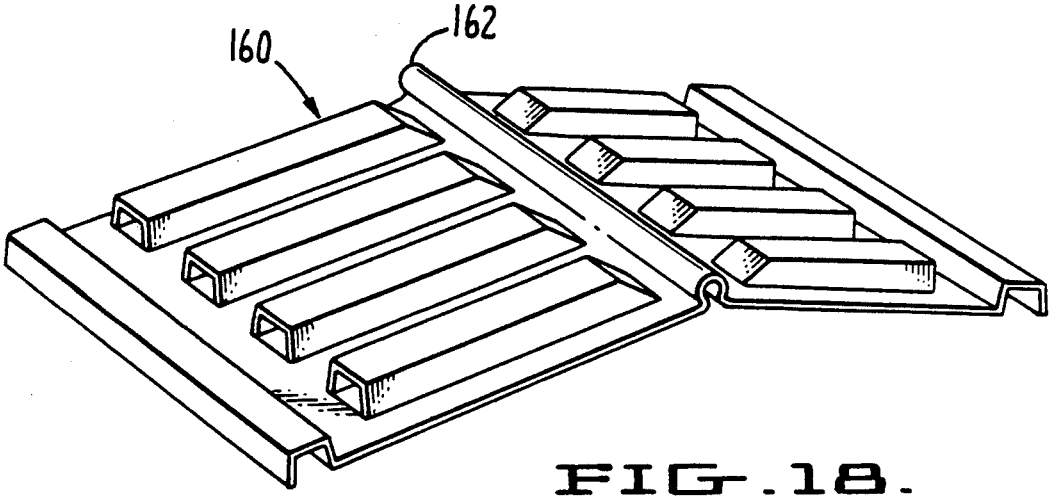
FIG. 18 is a cross-sectional view in perspective of a second embodiment of an adaptor of this invention.

In many situations, a roof surface will not be substantially planar, but rather is covered with weatherproofing materials having a three dimensional surface. In such situations, in order to have a weather tight seal between the ventilators and the roof surface, it is necessary to provide means for adapting the ventilators to the uneven roof surface. Accordingly, the present invention also provides solutions for adapting ventilators with planar extremities to non-planar roof surfaces as shown in FIGS. 16–18.

In one embodiment, separate adaptor panels 140 are provided which are capable of mating with both a ridge cap or fascia ventilator and an uneven roof surface. The adaptor panel 140 comprises a sheet of material having two distinct regions, a planar region 142 and a non-planar region 144. The non-planar region 144 is configured to mate snugly with a particular configuration of irregular roofing 146. FIG. 16 shows an adaptor panel 140 configured to mate with roofing 146 which is sinusoidally curved in cross-section. FIG. 18 shows an adaptor panel 140 that has the non-planar region 144 configured for snug receipt over a different roofing configuration.

Although the adaptation means has been illustrated in terms of separate panels, it should be understood the portions of the roof ridge ventilator or fascia ventilator could also be extended and then configured for receipt over an irregular roof surface. For instance, in the case of ridge cap ventilator 80, the ventilating member 82 could easily be extended beyond flange 98. This extended portion could then be molded to conform to an irregular roof surface.

In another aspect of the present invention, the ridge cap, fascia and gable ventilators described above are utilized in different combinations in a roof construction in order to achieve more efficient ventilating capacity.

Generally speaking, there is no preference embodiment for a particular type of ventilator, such as a ridge cap ventilator, when it is used in concert with other ventilators in a roof construction. However, it has been determined that ventilation is most fully and efficiently achieved when ventilators are provided at the roof ridge and along the base of the roof, such as at the gable and/or fascia. Without wishing to be bound by any theory of operation, it appears that this is so because eduction of warm air from the roof ridge creates a slightly lower pressure in the interior building space which draws in air from below through fascia and/or gable ventilators. Without a means of replacing air lost through the roof ridge, the lowering internal pressure would eventually inhibit the ability of warm air to exit through the roof ridge. When ventilation occurs below the roof ridge, a circulation pattern is created within the building space where air moves in from the outside in the lower reaches of the building space and exits through the roof ridge as it heats and rises.

Although ventilation is satisfactory when a roof construction is provided with only a ridge cap ventilator and a gable or a fascia ventilator, it is preferable to employ all three ventilator types in a single roof construction for maximum ventilating effect.

It is now apparent that the ventilators and ventilating systems of the present invention, as described and illustrated above, show marked improvements over available ventilators. It is to be understood, however, that although certain preferred embodiments have been disclosed and described above, other embodiments and changes are possible without departing from that which is the invention disclosed herein. It is intended therefore that the following claims define the invention, and that the structure within the scope of these claims and their equivalents be covered thereby.

I claim:

1. For ventilating a building through a roof having a gap extending transversely along the cornice of the roof, a fascia ventilator comprising:

ventilating means for allowing air to pass between an interior building space below the roof and the building exterior, said ventilating means comprising a ventilating member configured for receipt over the gap in the cornice and provided with a plurality of apertures; and a cover member configured for receipt by the cornice above the gap and for extending down over but spaced apart from said ventilating member, said cover member provided with a drip lip to prevent precipitation shed by the roof from running down a wall of the building.

2. The fascia ventilator of claim 1 further comprising a fiberglass mesh filter positioned over the cornice gap for preventing entry of insects and like pests.

3. For ventilating a building through a roof having a gap extending transversely along the cornice of the roof, a fascia ventilator comprising:

ventilating means for allowing air to pass between an interior building space below the roof and the building exterior, said ventilating means comprising a corrugated ventilating member configured for receipt by the cornice beneath the gap; and closure means for covering the cornice gap and for joining with said ventilating means to define a plurality of substantially parallel closed channels through air may pass.

4. The fascia ventilator of claim 3 further comprising a fiberglass mesh filter positioned over the cornice gap for preventing entry of insects and similar sized pests.

* * * * *